US006673131B2

(12) United States Patent
Botros

(10) Patent No.: US 6,673,131 B2
(45) Date of Patent: Jan. 6, 2004

(54) FUEL ADDITIVE COMPOSITIONS AND DISTILLATE FUELS CONTAINING SAME

(75) Inventor: Maged G. Botros, West Chester, OH (US)

(73) Assignee: Equistar Chemicals, LP, Houston, TX (US)

( * ) Notice: Subject to any disclaimer, the term of this patent is extended or adjusted under 35 U.S.C. 154(b) by 153 days.

(21) Appl. No.: 10/051,583

(22) Filed: Jan. 17, 2002

(65) Prior Publication Data

US 2003/0159336 A1 Aug. 28, 2003

(51) Int. Cl.[7] ..... C10L 1/18; C10L 1/22
(52) U.S. Cl. ..... 44/347; 44/394; 44/395
(58) Field of Search ..... 44/329, 347, 394, 44/395

(56) References Cited

U.S. PATENT DOCUMENTS

| | | | |
|---|---|---|---|
| 2,620,308 | A | 12/1952 | Stewart et al. |
| 2,965,678 | A | 12/1960 | Sundberg et al. |
| 2,977,334 | A | 3/1961 | Zopf et al. |
| 3,048,479 | A | 8/1962 | Ilnyckyj et al. |
| 3,250,599 | A | 5/1966 | Kirk et al. |
| 3,444,082 | A | 5/1969 | Kautsky et al. |
| 3,462,249 | A | 8/1969 | Tunkel et al. |
| 3,471,458 | A | 10/1969 | Mehmedbasich et al. |
| 3,560,456 | A | 2/1971 | Hazen et al. |
| 3,620,696 | A | 11/1971 | Hollyday, Jr. et al. |
| 3,694,176 | A | 9/1972 | Miller et al. |
| 3,854,893 | A | 12/1974 | Rossi |
| 3,966,428 | A | 6/1976 | Rossi |
| 4,151,069 | A | 4/1979 | Rossi |
| 4,178,950 | A | 12/1979 | Sweeney |
| 4,178,951 | A | 12/1979 | Sweeney |
| 4,240,916 | A | 12/1980 | Rossi |
| 4,402,845 | A | 9/1983 | Zoleski et al. |
| 4,746,327 | A | 5/1988 | Smyser |
| 4,862,908 | A | 9/1989 | Payer |
| 4,863,486 | A | 9/1989 | Tack et al. |
| 4,882,034 | A | 11/1989 | Tack et al. |
| 4,900,332 | A | 2/1990 | Denis et al. |
| 4,985,048 | A | 1/1991 | Wirtz et al. |
| 5,011,505 | A | 4/1991 | Lawtas et al. |
| 5,189,231 | A | 2/1993 | Canova et al. |
| 5,256,166 | A | 10/1993 | Fischer |
| 5,525,128 | A | 6/1996 | McAleer et al. |
| 5,681,359 | A | 10/1997 | Botros |
| 5,766,273 | A | 6/1998 | Dralle-Voss et al. |
| 6,071,993 | A | 6/2000 | Wenderoth et al. |
| 6,143,043 | A | 11/2000 | Botros |
| 6,203,583 | B1 | 3/2001 | Botros |
| 6,206,939 | B1 | 3/2001 | Botros |
| 6,342,081 | B1 | 1/2002 | Botros |

FOREIGN PATENT DOCUMENTS

| | | |
|---|---|---|
| EP | 0 030 099 | 11/1980 |
| EP | 0 196 217 | 3/1986 |
| EP | 0 254 284 | 7/1987 |
| EP | 0 654 526 | 11/1994 |
| GB | 1 245 879 | 9/1971 |
| GB | 1 374 051 | 11/1974 |
| GB | 1 593 672 | 7/1981 |
| JP | 56 141390 | 4/1980 |
| JP | 56 167791 | 5/1980 |
| JP | 61 287985 | 5/1985 |
| JP | 62 109892 | 11/1985 |
| NL | 1 940 944 | 8/1968 |

OTHER PUBLICATIONS

US 5,772,706, 6/1998, Schield et al. (withdrawn)

Hibara, t al.: Abstracts 91:213717e: and 91:195808d. *Chemical Abstracts*; vol. 91: p. 137–138 (1979).

Nishikawa, et al: Abstract 92:200767s. *Chemical Abstracts*. vol. 92: p. 143 (1980).

Coley, T.R.: "Diesel Fuel Additives Influencing Flow and Storage Properties," *Gasoline and Diesel Fuel Additives*: pp. 105–132.

Owen, K., et al: "Diesel Fuel Additives," *Automotive Fuels Reference Book*: 2nd Edition: Chapter 18: pp. 503–527.

*Primary Examiner*—Cephia D. Toomer
(74) *Attorney, Agent, or Firm*—Gerald A. Baracka; William A. Heidrich

(57) ABSTRACT

Improved fuel additives and distillate fuels containing said additives are described. The additives impart improved low temperature flow and filterability and also impart stability to distillate fuels, particularly hard-to-treat distillate fuels. The additives are a combination of an olefin/vinyl carboxylate polymer and two specific polyimides having different alkyl substituents.

20 Claims, No Drawings

FUEL ADDITIVE COMPOSITIONS AND DISTILLATE FUELS CONTAINING SAME

BACKGROUND OF THE INVENTION

1. Field of the Invention

This invention relates to improved fuel additive compositions. The fuel additives of the invention provide improved low temperature flow and filterability to distillate fuels, such as diesel fuels, and are substantially non-discoloring and non-corrosive. Distillate fuels containing the fuel additive compositions are also provided.

2. Description of the Prior Art

Distillate fuels such as diesel fuels tend to exhibit reduced flow at low temperatures due in part to formation of waxy solids in the fuel. The reduced flow of the distillate fuel affects transport and use of the distillate fuels in refinery operations and internal combustion engine. This is a particular problem during the winter months and especially in northern regions where the distillates are frequently exposed to temperatures at which solid formation begins to occur in the fuel, generally known as the cloud point (ASTM D 2500) or wax appearance point (ASTM D 3117). The formation of waxy solids in the fuel will in time essentially prevent the ability of the fuel to flow, thus plugging transport lines such as refinery piping and engine fuel supply lines. Under low temperature conditions during consumption of the distillate fuel, as in a diesel engine, wax precipitation and gelation can cause the engine fuel filters to plug which can be simulated in the laboratory using tests such as the low-temperature flow test (LTFT). This test, ASTM Designation D 4539-98, estimates the filterability of diesel fuels in automotive equipment at low temperatures. For the test, fuel samples are cooled at a prescribed rate and at the desired temperature and each 1° C. interval thereafter, a specimen of the fuel is filtered through a 17 $\mu$m screen utilizing a vacuum system. The minimum LTFT pass temperature is the lowest temperature at which the prescribed volume of fuel (180 ml) can be filtered in 60 seconds or less. Alternatively, a single fuel specimen may be cooled in the above-described manner and tested at a specified temperature to determine whether it passes or fails at that temperature.

As used herein, distillate fuels encompass a range of fuel types, typically including but not limited to kerosene, intermediate or middle distillates, lower volatility distillate gas oils and higher viscosity distillates. Grades encompassed by the term include Grades No. 1-D, 2-D and 4-D for diesel fuels as defined in ASTM D975, incorporated herein by reference. The distillate fuels are useful in a range of applications, including use in automotive diesel engines and in non-automotive applications under both varying and relatively constant speed and load conditions.

Distillate fuels are comprised of a mixture of hydrocarbons including normal and branched-chain paraffins, olefins, aromatics and other polar and non-polar compounds, and cold flow behavior is a function of the relative proportion of these various hydrocarbon components. Normal paraffins typically have the lowest solubility and therefore tend to be the first solids to separate from the fuel as the temperature is decreased. At first, individual paraffin crystals will appear but as more crystals form they will ultimately create a gel-like network which inhibits flow. The compositional makeup of fuels can vary widely depending on the crude oil source and how deeply the refiner cuts into the crude oil. With mounting pressure on refiners to increase production of distillate fuels, they are increasingly producing fuels with amounts and types of hydrocarbon components which render the fuels unresponsive to additives heretofore capable of imparting acceptable cold flow properties to the fuels. These fuels are referred to within the industry as "hard-to-treat" fuels.

A number of compositional features can contribute to the unresponsiveness of hard-to-treat fuels to flow additives, including one or more of the following: a narrow molecular weight distribution of waxes; the virtual absence of high molecular weight waxes; inordinately large amounts of very high molecular weight waxes; a higher percentage (total) of wax; and a higher average carbon number for the normal paraffin component. While it is difficult to generate a single set of parameters which define hard-to-treat fuels, they are typically characterized by one or more of the following distillation parameters (as determined by test method ASTM D 86 incorporated herein by reference): the temperature differential between the 20% distilled and 90% distilled fractions; the temperature differential between the 90% distilled fraction and the final boiling point; and the final boiling point.

Useful cold flow improvers for distillate fuels, including hard-to-treat fuels, are disclosed in U.S. Pat. No. 6,203,583. The cold flow additives of the invention are a combination of an ethylene/vinyl acetate/isobutylene copolymer with one or more of a maleic anhydride/$\alpha$-olefin copolymer component, a polyimide component and an alkylphenol component. Similar compositions useful as wax anti-settling agents and cloud point depressants for distillate fuels are disclosed in U.S. Pat. Nos. 6,206,939 and 6,143,043, respectively.

While certain of the above-mentioned additives do improve cold flow properties of distillate fuels to some extent, there continues to be a need for additives which exhibit enhanced performance, particularly for hard-to-treat fuels. For example, there is an ongoing need for cold flow improver additives which do not interact with the distillate fuel or other additives commonly contained therein and, in turn, discolor the fuel or cause the formation of undesirable deposits upon storage. Cold flow improver additives which tend to discolor distillate fuels, either by interaction with other additives, e.g., stabilizers, or by other means, can interfere with or mask dyes which are added to differentiate fuels, such as dyes added to tax-exempt off-road fuel. Accordingly, it would be highly advantageous if cold flow improver fuel additive compositions were available which provided both improved cold flow performance and stability for distillate fuels. It would be even more useful if the fuel additives were substantially non-acidic to prevent corrosion of metal storage tanks and transfer lines.

SUMMARY OF THE INVENTION

The present invention relates to improved fuel additive compositions and to distillate fuels, including hard-to-treat distillate fuels, containing said additives. The additives of the invention impart improved low temperature flow and filterability to distillate fuels and also serve to stabilize the fuels against the development of undesirable color or deposits upon storage. The fuel additives are a combination of an olefin/vinyl carboxylate polymer with first and second polyimides of specific structure. More specifically, the additives comprise (a) an olefin/vinyl carboxylate polymer selected from the group consisting of ethylene/vinyl acetate copolymers; ethylene/vinyl acetate/isobutylene terpolymers and mixtures thereof; (b) a first polyimide corresponding to the general formula

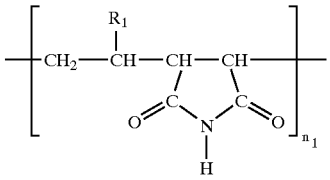

where $R_1$ is an alkyl group with an average carbon number of 22 to 26 carbon atoms and $n_1$ is from about 1.5 to 8; and (c) a second polyimide corresponding to the general formula

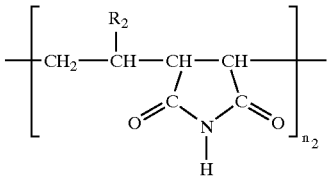

where $R_2$ is an alkyl group with an average carbon number greater than 30 and $n_2$ is from about 1.5 to 8; said first polyimide and said second polyimide present at a weight ratio of 1:5 to 5:1 and the weight ratio of olefin/vinyl carboxylate polymer to the combined weight of said first and second polyimides ranging from 4:1 to 1:4.

Improved distillate fuel compositions containing 100 to 5000 ppm of the above-defined additives are also provided.

DETAILED DESCRIPTION

In accordance with the present invention, fuel additive compositions are provided which impart significantly improved cold flow properties, i.e., flowability and filterability, to distillate fuels and particularly hard-to-treat distillate fuels. Additionally, the fuel additive compositions of the invention do not adversely affect fuel stability.

The additive compositions of the invention are comprised of an olefin/vinyl carboxylate polymer and a mixture of a first polyimide and a second polyimide, said polyimides having repeating units corresponding to the general structure:

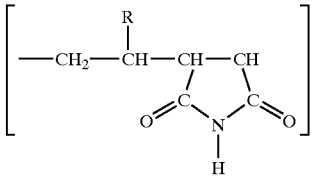

but differing in the number of carbon atoms in the pendant R group. The olefin/vinyl carboxylate polymer and first and second polyimides are present within prescribed weight ratio limits.

Useful olefin/vinyl carboxylate polymers include ethylene/vinyl acetate copolymers (EVA) and ethylene/vinyl acetate/isobutylene terpolymers (EVAiB) or combinations thereof. The EVA and EVAiB polymers will have weight average molecular weights in the range of about 1,500 to about 18,000, number average molecular weights in the range of about 400 to about 3,000 and a ratio of weight average molecular weight to number average molecular weight from about 1.5 to about 6. Preferably the weight average molecular weight ranges from about 3,000 to about 12, 000 and the number average molecular weight ranges from about 1,500 to about 2,500. The EVA and EVAiB polymers have Brookfield viscosities in the range of about 100 to about 300 centipoise (cP) at 140° C. More typically the Brookfield viscosity is in the range of about 100 to about 200 centipoise. Vinyl acetate contents will range from about 25 to about 55 weight percent. Preferably the vinyl acetate content ranges from about 25 to about 45 weight percent and, even more preferably, from about 27 to about 38 weight percent. The branching index is from 2 to 15 and, more preferably, 5 to 10. The EVA copolymers and terpolymers are produced in accordance with known procedures. For example, the EVAiB copolymers are described in U.S. Pat. Nos. 5,256,166 and 5,681,359 which are incorporated herein by reference.

A first and second polyimide are combined with the EVA, EVAiB or EVA/EVAiB blend to obtain the improved fuel additive compositions of the invention. The polyimides correspond to the general formula:

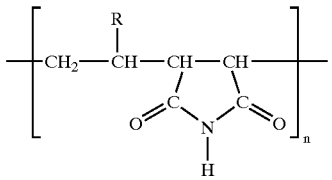

where R represents an alkyl moiety and n is the number of repeating units of the polyimide. The first and second polyimides utilized to obtain the improved compositions of the invention have different alkyl substituents, which are hereinafter respectively designated as $R_1$ and $R_2$. The number of repeating units of the first and second polyimide may be the same or different and are hereinafter respectively designated $n_1$ and $n_2$.

The alkyl substituent ($R_1$) for the first polyimide will be an alkyl group with an average carbon number of 22 to 26 carbon atoms. Preferably 60% or more of the alkyl substituents of the first polyimide will have 22 to 26 carbon atoms. Most preferably, the alkyl substituent $R_1$ of the first polyimide is comprised of at least 70% $C_{22-26}$ alkyl substituents. The number of repeating units ($n_1$) of the first polyimide will be from about 1.5 to 8 and the number average molecular weight (Mn) will range from about 600 to 8000. Weight average molecular weights (Mw) range from about 1500 to 15000.

The second polyimide will have an alkyl substituent ($R_2$) with an average carbon number substantially higher than that of the first polyimide. $R_2$ for the second polyimide will have an average carbon number greater than 30. Preferably 60% or more of the alkyl substituents of the second polyimide will have 30 to 36 carbon atoms. Most preferably at least 70% of the $R_2$ alkyl substituents will be $C_{30-36}$ alkyl substituents. The number of repeating units ($n_2$) for the second polyimide will be from about 1.5 to 8 and the number average molecular weight will range from about 650 to 9500. Weight average molecular weights for the second polyimide are from about 2000 to 21000.

Both polyimides are produced using known procedures wherein an α-olefin having the requisite number of carbon atoms is copolymerized with a substantially equimolar amount of maleic anhydride by means of free radical catalysis and in a subsequent reaction forming the corresponding polyimide by neutralizing with ammonia at an elevated temperature. α-Olefins used in making the α-olefin/maleic anhydride copolymer precursors are mixtures of α-olefins having a distribution of carbon numbers so as to obtain the different alkyl substituents for the first and second polyimides. For example, to produce a first polyimide wherein 60% or more of the alkyl groups ($R_1$) have 22 to 26 carbon atoms, an α-olefin wherein 60% or more of the olefins contain 24 to 28 carbon atoms would be reacted with maleic anhydride to form the α-olefin/maleic anhydride precursor.

Effective fuel additive compositions are obtained by combining the EVA copolymer, EVAiB terpolymer or combination thereof and the first and second polyimides at a weight ratio of from 4:1 to 1:4 and, more preferably, from 2:1 to 1:2. The polyimide component in the foregoing weight ratios represents the total weight of both the first and second polyimides. The first and second polyimides are utilized at weight ratios from 1:5 to 5:1 and, more preferably, from 1:2.5 to 2.5:1. In one highly useful embodiment, 2 parts EVA, EVAiB, or mixture thereof are combined with 1 part first polyimide and 1 part second polyimide.

The fuel additive compositions of the invention are typically added to the distillate fuels at levels from about 100 ppm up to about 5000 ppm. While higher levels of additive can be used, any additional benefit obtained does not usually justify the additional cost. Especially useful additive levels are 150 to 3000 ppm and, more preferably, 200 to 2500 ppm.

The following detailed examples illustrate the practice of the invention in its most preferred form, thereby enabling a person of ordinary skill in the art to practice the invention. The principles of this invention, its operating parameters and other obvious modifications thereof, will be understood in view of the following detailed procedure. All parts and percentages in the examples are on a weight basis unless otherwise indicated.

To demonstrate the improved cold flow performance of the additive compositions, the additives were combined with various diesel fuels at weight concentrations ranging from 125 to 1000 ppm. All of the fuel formulations were prepared by the addition of a concentrate containing 10% of the additive composition (2 parts ethylene/vinyl carboxylate copolymer or terpolymer, 1 part first polyimide and 1 part second polyimide) in a mixed aromatic solvent (Aromatic 100). The desired concentration of additive in the fuel was obtained by varying the amount of concentrate added to the fuel.

Three olefin/vinyl carboxylate (OVC) polymers were utilized to prepare the various fuel additive compositions utilized in the examples and they are identified in Table 1. Polyimides used for the fuel additive compositions are identified in Table 2. Brookfield viscosities for the first polyimides (P1) and second polyimides (P2) used are provided. Brookfield viscosities for the polyimides were determined using hydrocarbon (Aromatic 100) solutions containing 35 weight % polyimide. The acid numbers for the α-olefin/maleic anhydride from which each of the polyimides was derived are included in the table.

TABLE I

| | Polymer Type | Brookfield Viscosity at 140° C. (cP) | VA Content (%) | Mn | Mw | Mw/Mn |
|---|---|---|---|---|---|---|
| OVC1 | EVA copolymer | 115 | 32 | 1889 | 3200 | 1.69 |
| OVC2 | EVAiB terpolymer | 125 | 37 | 2237 | 11664 | 5.2 |
| OVC3 | a 1:1 blend of OVC1 and OVC2 | | | | | |

TABLE 2

| | Brookfield Viscosity (cP/° C.) | Precursor Acid Number |
|---|---|---|
| P1 A | 15.1/23 | 130.5 |
| P1 B | 19.1/23 | 152.5 |
| P2 A | 18.8/45 | 128.7 |
| P2 B | 147.3/23 | 193.6 |

Various fuels were used in the examples to demonstrate the improved performance of the additive compositions of the invention. The fuels are listed in Table 3 with distillation data for each determined in accordance with ASTM D 86. The data include the initial boiling point (IBP), final boiling point (FBP) and the temperature at which specific volume percentages of the fuel have been recovered from the original pot contents at atmospheric pressure. All temperatures are in ° C.

Table 4 sets forth the distillation criteria generally utilized by the industry to characterize hard-to-treat fuels. This criteria utilizes the temperature difference between the 20% distilled and 90% distilled temperatures (90%–20%), the temperature difference between the 90% distilled temperature and final boiling point (FBP-90%) and the final boiling point. A 90%–20% temperature difference of about 100–120° C. for middle distillate cut fuels is considered normal. A difference of about 70°–100° C. is considered narrow and hard-to-treat and a difference of less than about 70° C. is considered extremely narrow and very hard-to-treat. A FBP-90% temperature difference in the range of 25° C. to about 35° C. is considered normal. A difference of less than about 25° C. is considered narrow and hard-to-treat. A difference of more than about 35° C. is also considered hard-to-treat. A final boiling point below about 360° C. or above about 380° C. is considered hard-to-treat. Additional disclosure on hard-to-treat fuels is found in U.S. Pat. No. 5,681,359, incorporated herein by reference. From an examination of the distillation data provided in Table 4, it will be observed that all of the fuels employed for the examples satisfy one or more of the above-described criteria and would therefore be considered hard-to-treat fuels.

TABLE 3

| | | Percent Distilled | | | | | | | | | | | |
|---|---|---|---|---|---|---|---|---|---|---|---|---|---|
| | IBP | 5% | 10% | 20% | 30% | 40% | 50% | 60% | 70% | 80% | 90% | 95% | FBP |
| Fuel 1 | 164 | 176 | 182 | 191 | 202 | 214 | 223 | 234 | 247 | 261 | 288 | 316 | 333 |
| Fuel 2 | 166 | 186 | 199 | 216 | 229 | 243 | 255 | 266 | 279 | 293 | 311 | 329 | 333 |
| Fuel 3 | 161 | 180 | 186 | 199 | 211 | 224 | 239 | 253 | 269 | 292 | 323 | 348 | 354 |
| Fuel 4 | 193 | 206 | 216 | 243 | 255 | 266 | 278 | 284 | 292 | 308 | 332 | 336 | 346 |
| Fuel 5 | 178 | 204 | 213 | 226 | 237 | 249 | 259 | 270 | 283 | 297 | 314 | 327 | 352 |
| Fuel 6 | 173 | 198 | 211 | 228 | 241 | 253 | 263 | 273 | 284 | 297 | 313 | 225 | 352 |
| Fuel 7 | 193 | 211 | 219 | 231 | 242 | 252 | 262 | 272 | 283 | 295 | 312 | 331 | 334 |
| Fuel 8 | 196 | 211 | 219 | 232 | 236 | 252 | 261 | 271 | 281 | 296 | 314 | 333 | 336 |
| Fuel 9 | 222 | 239 | 244 | 251 | 260 | 268 | 274 | 283 | 293 | 305 | 322 | 334 | 356 |

TABLE 4

| | 90–20% | FBP-90% | FBP |
|---|---|---|---|
| Fuel 1 | 97 | 45 | 333 |
| Fuel 2 | 95 | 22 | 333 |
| Fuel 3 | 124 | 31 | 354 |
| Fuel 4 | 89 | 14 | 346 |
| Fuel 5 | 88 | 38 | 352 |
| Fuel 6 | 85 | 39 | 352 |
| Fuel 7 | 81 | 22 | 334 |
| Fuel 8 | 82 | 22 | 336 |
| Fuel 9 | 71 | 34 | 356 |

EXAMPLES 1–6

A series of six additive compositions were prepared in accordance with the invention and evaluated as cold flow enhancers for hard-to-treat fuel 1. The fuel additive compositions were utilized at a 500 ppm treat rate and evaluated using the LTFT test procedure (ASTM D 4539-98). In this instance, the fuels were cooled as prescribed by the test procedure and tested at −37° C. to determine whether the fuels passed or failed at that temperature. A control, i.e., fuel 1 containing no additive, was also evaluated. Test results are tabulated below.

| Example | Additive Composition | LTFT Results at −37° C. |
|---|---|---|
| Control | None | Failed; 0 mls fuel was filtered |
| 1 | OVC1 + P1 A + P2 A | Passed; 180 mls filtered in 16 seconds |
| 2 | OVC2 + P1 A + P2 A | Passed; 180 mls filtered in 19 seconds |
| 3 | OVC3 + P1 A + P2 A | Passed; 180 mls filtered in 18 seconds |
| 4 | OVC1 + P1 B + P2 B | Passed; 180 mls filtered in 16 seconds |
| 5 | OVC2 + P1 B + P2 B | Passed; 180 mls filtered in 15 seconds |
| 6 | OVC3 + P1 B + P2 B | Passed; 180 mls filtered in 15 seconds |

The improved filterability obtained by the use of the additive compositions of the invention is readily apparent from the data. Whereas it was not possible to pump any of fuel 1 at −37° C. under the test conditions, all of the fuel samples containing the additives passed the LTFT test at −37° C. In fact, they all filtered in times well under 60 seconds which suggests they would pass the test at even lower temperatures and/or at even lower additive levels.

EXAMPLE 7

To demonstrate the ability to reduce the fuel additive concentration the following experiment was conducted. For this experiment hard-to-treat fuel 2 was employed. The additive was employed at a concentration of 250 ppm and consisted of a blend of OVC1, P1 A and P2 A at a ratio of 2:1:1. The LTFT test was conducted at −27° C. The fuel containing 250 ppm of the additive composition passed the test. The prescribed volume (180 mls) was filtered in 31.7 seconds. The control, i.e., fuel 2 containing no additive, failed the test. Only 4 drops were filtered in the prescribed 60 second test interval. When the concentration of the additive composition in the fuel was lowered to 125 ppm, it was not possible to pass the LTFT test at −27° C. Only 25 mls of fuel 2 containing 125 ppm of the additive composition were filtered in 60 seconds.

EXAMPLES 8–13

The fuel additive compositions of Examples 1–6 were incorporated in fuel 3 at a 750 ppm treat level. All of the fuel blends containing the additive compositions passed the LTFT filterability test at −20° C. Results are tabulated below along with the results obtained for the control.

| Example | Additive Composition | LTFT Results at −20° C. |
|---|---|---|
| Control | None | Failed; 0 mls fuel was filtered |
| 8 | OVC1 + P1 A + P2 A | Passed; 180 mls filtered in 15 seconds |
| 9 | OVC2 + P1 A + P2 A | Passed; 180 mls filtered in 11 seconds |
| 10 | OVC3 + P1 A + P2 A | Passed; 180 mls filtered in 12 seconds |
| 11 | OVC1 + P1 B + P2 B | Passed; 180 mls filtered in 16 seconds |
| 12 | OVC2 + P1 B + P2 B | Passed; 180 mls filtered in 19 seconds |
| 13 | OVC3 + P1 B + P2 B | Passed; 180 mls filtered in 14 seconds |

The significance of the LTFT results set forth above is even more apparent when compared with the results obtained using the ethylene/maleic anhydride precursors of P1 A and P2 A. When Example 9 was repeated except that the corresponding ethylene/maleic anhydride copolymer precursors were substituted for P1 A and P2 A, the fuel failed the LTFT test at −20° C. Only 152 mls of the fuel was filtered within the prescribed 60 second test interval.

EXAMPLES 14–19

Whereas the foregoing examples clearly illustrate the unexpected and significant improvement in LTFT filterability obtained using the compositions of the invention, additional fuel formulations were prepared and evaluated to demonstrate their improved stability, as evidenced by the elimination or minimization of formation of undesirable color bodies and/or deposits upon aging. For these formulations fuels 4–9 were employed. To each fuel was added 1000 ppm of the additive composition of Example 9 (2 parts OVC 2 with 1 part P1 A and 1 part P2 A). For comparison, each fuel was also formulated with 1000 ppm of a composition comprised of 2 parts OVC2 with 1 part each of the ethylene/maleic anhydride copolymer precursors of P1 A and P2 A. The fuel formulations were heated for 16 hours at 50° C. and then stored at room temperature for 45 days. The fuel samples were visually inspected at the beginning and end of the test period and the results recorded. Absorbance and percent transmittance were also determined spectrophotometrically for the aged fuel samples 14–18 and their corresponding comparative formulations. Spectrophotometric measurements were made in the visible (500 nanometer) range. Results are reported in Table 5. It is apparent from the data that the fuels formulated with the additives of the invention have significantly improved stability compared to the fuels formulated with the precursor ethylene/maleic anhydride copolymers. Very little if any change in color was observed upon aging with the fuel formulations of the invention and no undesirable deposits were formed.

TABLE 5

| Example | Visual Initial | Visual After Storage | Absorbance | % Transmittance |
|---|---|---|---|---|
| 14 | Clear | Clear | 0.021 | 95.4 |
| Comparative 14 | Clear | Turbid | 0.198 | 63.4 |
| 15 | Yellow | Yellow | 0.226 | 59.3 |
| Comparative 15 | Yellow | Brown | 0.407 | 39.2 |
| 16 | Light brown | Light brown | 0.686 | 20.6 |
| Comparative 16 | Light brown | Black | 1.078 | 8.4 |
| 17 | Light yellow | Light yellow | 0.00 | 100 |
| Comparative 17 | Light yellow | Mid-dark yellow | 0.025 | 94.1 |
| 18 | Yellow | Yellow | 0.021 | 95.3 |
| Comparative 18 | Yellow | Dark yellow | 0.08 | 83.2 |
| 19 | Clear | Clear | — | — |
| Comparative 19 | Clear | Dark brown-black deposit formed | — | — |

I claim:

1. A distillate fuel composition having improved stability and low temperature flow and filterability comprising a major portion of a distillate fuel and 100 to 5000 ppm of an additive composition comprising:

(a) an olefin/vinyl carboxylate polymer selected from the group consisting of ethylene/vinyl acetate copolymers; ethylene/vinyl acetate/isobutylene terpolymers and mixtures thereof;

(b) a first polyimide corresponding to the general formula:

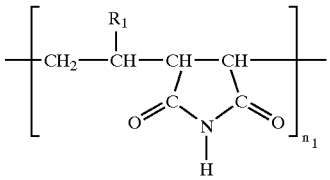

where $R_1$ is an alkyl group with an average carbon number of 22 to 26 carbon atoms and $n_1$ is from about 1.5 to 8; and (c) a second polyimide corresponding to the general formula

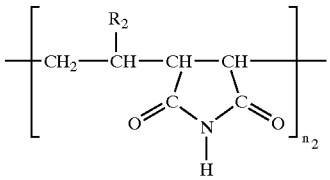

where $R_2$ is an alkyl group with an average carbon number greater than 30 and $n_2$ is from about 1.5 to 8.

2. The distillate fuel composition of claim 1 wherein the weight ratio of olefin/vinyl carboxylate polymer to the combined weight of said first and second polyimides is from 4:1 to 1:4.

3. The distillate fuel composition of claim 2 wherein the weight ratio of said first polyimide to said second polyimide is from 1:5 to 5:1.

4. The distillate fuel composition of claim 1 wherein the olefin/vinyl carboxylate polymer has a Brookfield viscosity of 100 to 300 centipoise at 140° C. and vinyl acetate content of 25 to 55 weight percent.

5. The distillate fuel composition of claim 4 wherein the vinyl acetate content of the olefin/vinyl carboxylate polymer is from 25 to 45 weight percent.

6. The distillate fuel composition of claim 4 wherein the Brookfield viscosity of the olefin/vinyl carboxylate polymer is 100 to 200 centipoise at 140° C.

7. The distillate fuel composition of claim 1 wherein $R_1$ of the first polyimide is comprised of at least 60 percent $C_{22-26}$ alkyl substituents, $R_2$ of the second polyimide is comprised of at least 60 percent $C_{33-36}$ alkyl substituents and the weight ratio of the first polyimide to second polyimide is from 1:2.5 to 2.5:1.

8. The distillate fuel composition of claim 7 wherein the first polyimide has a number average molecular weight from 600 to 8000 and weight average molecular weight from 1500 to 15000.

9. The distillate fuel composition of claim 7 wherein the second polyimide has a number average molecular weight from 650 to 9500 and weight average molecular weight from 2000 to 21000.

10. The distillate fuel composition of claim 1 containing from 100 to 3000 ppm of the additive composition.

11. The distillate fuel composition of claim 1 wherein said distillate fuel is a hard-to-treat fuel.

12. A fuel additive composition for improving the low temperature flow and filterability of distillate fuels comprising:

(a) an olefin/vinyl carboxylate polymer selected from the group consisting of ethylene/vinyl acetate copolymers; ethylene/vinyl acetate/isobutylene terpolymers and mixtures thereof;

(b) a first polyimide corresponding to the general formula:

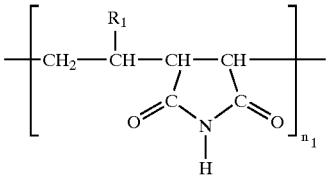

where $R_1$ is an alkyl group with an average carbon number of 22 to 26 carbon atoms and $n_1$ is from about 1.5 to 8; and (c) a second polyimide corresponding to the general formula

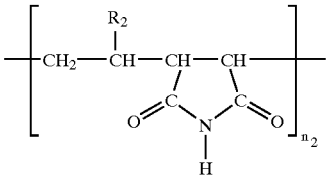

where $R_2$ is an alkyl group with an average carbon number greater than 30 and $n_2$ is from about 1.5 to 8; said first polyimide and said second polyimide present at a weight ratio of 1:5 to 5:1 and the weight ratio of olefin/vinyl carboxylate polymer to the combined weight of said first and second polyimides ranging from 4:1 to 1:4.

13. The fuel additive of claim 12 wherein the olefin/vinyl carboxylate polymer has a Brookfield viscosity of 100 to 300 centipoise at 140° C. and vinyl acetate content of 25 to 55 weight percent.

14. The fuel additive of claim 13 wherein the Brookfield viscosity of the olefin/vinyl carboxylate polymer is 100 to 200 centipoise at 140° C. and the vinyl acetate content is from 25 to 45 percent.

15. The fuel additive of claim 12 wherein $R_1$ of the first polyimide is comprised of at least 60 percent $C_{22-26}$ alkyl substituents, $R_2$ of the second polyimide is comprised of at least 60 percent $C_{33-36}$ alkyl substituents and the weight ratio of the first polyimide to second polyimide is from 1:2.5 to 2.5:1.

16. The fuel additive of claim 15 wherein $R_1$ of the first polyimide is comprised of at least 70 percent $C_{22-26}$ alkyl substituents.

17. The fuel additive of claim 16 wherein the first polyimide has a number average molecular weight from 600 to 8000 and weight average molecular weight from 1500 to 15000.

18. The fuel additive of claim 15 wherein $R_2$ of the second polyimide is comprised of at least 70 percent $C_{30-36}$ alkyl substituents.

19. The fuel additive of claim 18 wherein the second polyimide has a number average molecular weight from 650 to 9500 and weight average molecular weight from 2000 to 21000.

20. The fuel additive of claim 1 wherein the weight ratio of olefin/vinyl carboxylate polymer to the combined weight of the first and second polyimides is from 2:1 to 1:2.

* * * * *